US011111916B1

(12) United States Patent
Lawson et al.

(10) Patent No.: US 11,111,916 B1
(45) Date of Patent: Sep. 7, 2021

(54) RECIPROCATING PUMP PACKING NUT ASSEMBLY

(71) Applicant: LWF Services, LLC, Odessa, TX (US)

(72) Inventors: Jeffrey Alan Lawson, Midland, TX (US); Christopher James Lawson, Odessa, TX (US)

(73) Assignee: LWF Services LLC, Odessa, TX (US)

( * ) Notice: Subject to any disclaimer, the term of this patent is extended or adjusted under 35 U.S.C. 154(b) by 0 days.

(21) Appl. No.: 17/243,029

(22) Filed: Apr. 28, 2021

Related U.S. Application Data

(63) Continuation of application No. 17/301,895, filed on Apr. 19, 2021.

(60) Provisional application No. 63/068,818, filed on Aug. 21, 2020.

(51) Int. Cl.
*F04B 53/16* (2006.01)
*F04B 53/22* (2006.01)
*F04B 53/02* (2006.01)

(52) U.S. Cl.
CPC ..... *F04B 53/16* (2013.01); *F04B 53/02* (2013.01); *F04B 53/22* (2013.01)

(58) Field of Classification Search
CPC ..... F04B 53/02; F04B 53/22; F04B 53/16; F16B 39/10; F16B 39/101; G05G 5/14; G05G 5/18; G05G 5/20; G05G 5/24
USPC ..... 92/165 R, 165 PR, 128; 417/572; 411/102, 90, 92, 95, 96, 119, 121, 949, 411/950; 74/575–578
See application file for complete search history.

(56) References Cited

U.S. PATENT DOCUMENTS 404,326 A * 5/1889 Vinyard ..... F16B 39/101 411/96
3,620,574 A * 11/1971 Cox ..... B60B 3/16 301/39.1
7,891,923 B2 * 2/2011 Marczynski ..... F16B 39/101 411/102
8,529,230 B1 * 9/2013 Colley, III ..... F16B 39/04 417/572
10,184,470 B2 * 1/2019 Barnett, Jr. ..... F04B 1/0452

* cited by examiner

*Primary Examiner* — Charles G Freay
*Assistant Examiner* — Chirag Jariwala
(74) *Attorney, Agent, or Firm* — Chamberlain Hrdlicka

(57) ABSTRACT

A reciprocating pump assembly that includes a power end, first and second stay rods coupled to the power end, and a fluid end that includes a mounting flange coupled to the first and second stay rods and a packing nut assembly. The packing nut assembly includes a packing nut threadably engaged with the mounting flange and comprising a gear pattern, and a retention assembly that includes a collar, an alignment arm, a pawl, and a biasing assembly. The collar extends around the first stay rod. The alignment arm is coupled to the collar and shaped to contact the second stay rod. The pawl is pivotally coupled to the alignment arm or the collar and positioned to engage the gear pattern to allow the packing nut thread into the mounting flange and prevent the packing nut from unthreading. The biasing assembly biases the pawl into engagement with the gear pattern.

20 Claims, 5 Drawing Sheets

RECIPROCATING PUMP PACKING NUT ASSEMBLY

BACKGROUND

This section is intended to provide relevant background information to facilitate a better understanding of the various aspects of the described embodiments. Accordingly, it should be understood that these statements are to be read in this light and not as admissions of prior art.

Hydrocarbons, such as oil and gas, are commonly obtained from subterranean formations that may be located onshore or offshore. Subterranean operations and the processes involved in removing hydrocarbons from a subterranean formation are complex. Typically, subterranean operations involve a number of different steps such as, for example, drilling a borehole at a desired well site, treating the borehole to optimize production of hydrocarbons, and performing the necessary steps to produce and process the hydrocarbons from the subterranean formation.

Many of these subterranean operations rely on fluids that are pressurized via pumping assemblies, such as reciprocating pumps. However, vibrations caused by the operation of the reciprocating pump can be severe enough to loosen threaded components of the pump. Over time, the loosening of the threaded components can cause leaks and reduce the performance of the reciprocating pump.

BRIEF DESCRIPTION OF THE DRAWINGS

Embodiments of a reciprocating pump packing nut assembly are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a reciprocating pump packing nut assembly. The packing nut assembly includes a packing nut and a retention assembly. The retention assembly engages with the packing nut to prevent the packing nut from unthreading and backing out of a mounting flange of a fluid end of the reciprocating pump during operation of the pump.

Figure 1:
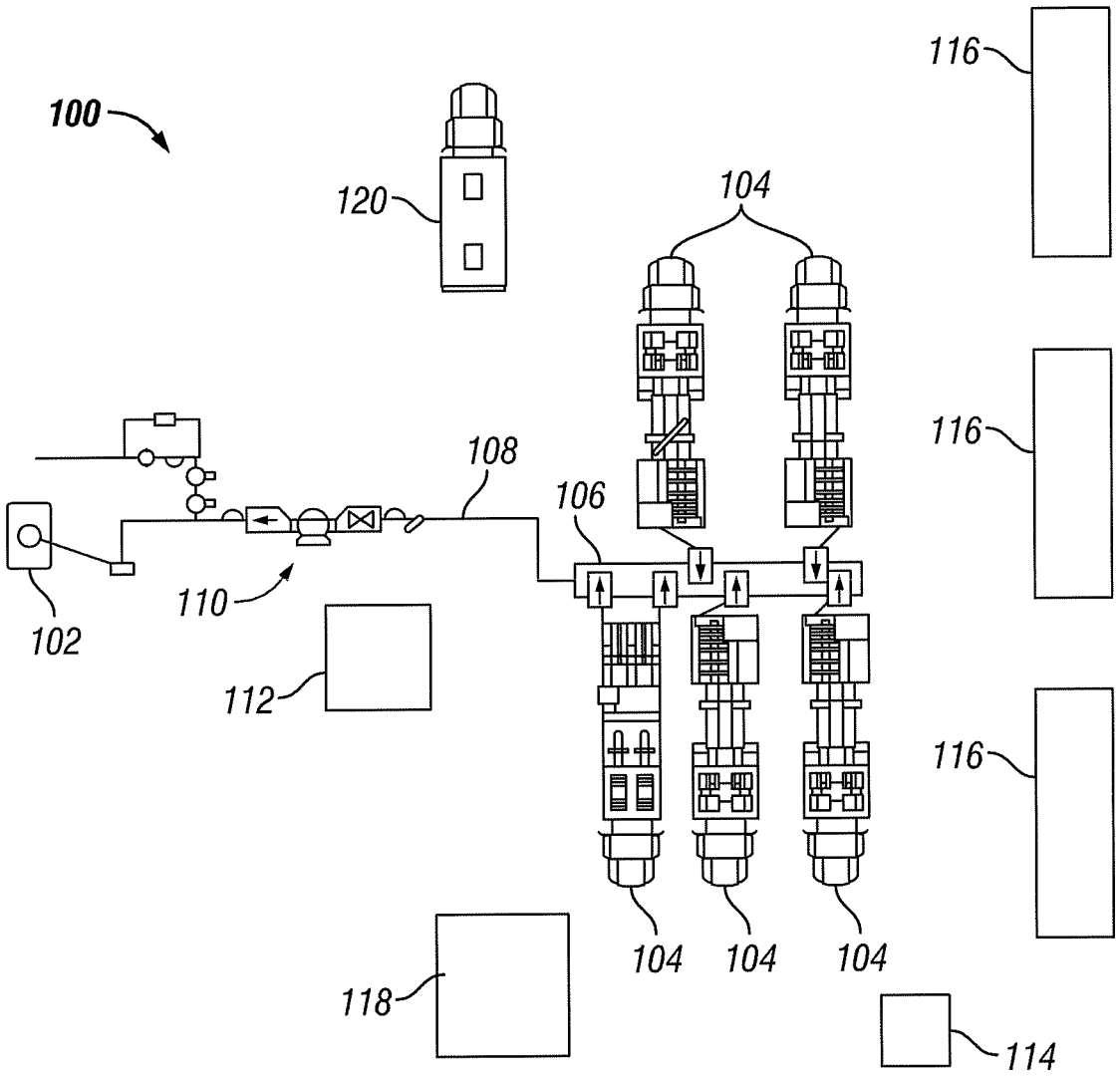
FIG. 1 is a schematic view of a wellsite according to one or more embodiments.

FIG. 1 is a schematic diagram of a wellsite 100, according to one or more embodiments. Turning to FIG. 1, the wellsite includes a wellhead 102 positioned over a wellbore (not shown) and connected to one or more pieces of wellsite equipment, such as, pumping systems 104. The pumping systems 104 are connected to a manifold 106 and piping 108. Further, the piping 108 may include additional equipment, such as, valves 110 and flowmeters (not shown). This additional equipment may be used, e.g., to monitor and/or control the flow of fluid into a wellbore through the wellhead 102.

The wellsite 100 may also include other pieces of equipment, such as, a generator 112, a blender 114, storage tanks 116 (three shown), a fluid distribution system 118, and a monitoring and control unit 120. Each of these additional pieces of equipment is described below.

The storage tanks 116 may contain fuel, wellbore fluids, proppants, diesel exhaust fluid, and/or other fluids. The fluid distribution system 118 is fluidly coupled to one or more pieces of wellsite equipment, such as, the pumping systems 104, the generator 112, the blender 114, or the monitoring and control unit 120. The fluid distribution system 118 may supply fluids, such as, fuel, diesel exhaust fluid, fracturing fluid, and/or other fluids, to the pieces of wellsite equipment 104, 112, 114 from one or more of the storage tanks 116. In one or more embodiments, all or a portion of the aforementioned wellsite equipment may be mounted on trailers. However, the wellsite equipment may also be free standing or mounted on a skid.

Figure 2:
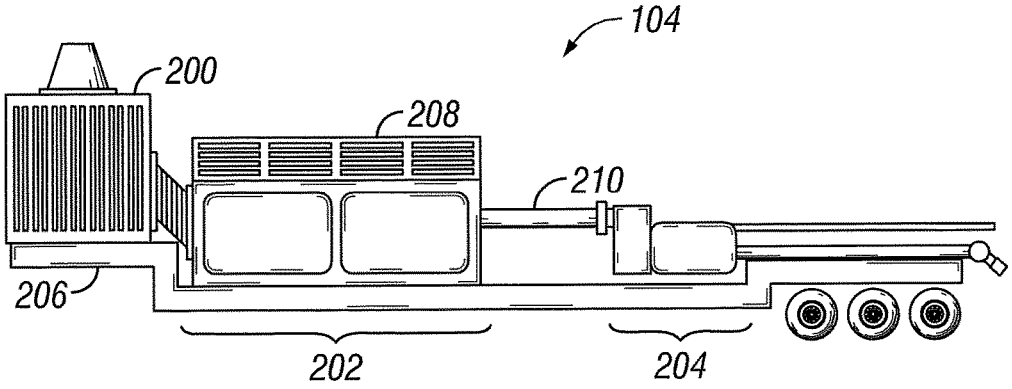
FIG. 2 is a schematic diagram of a pumping system shown in FIG. 1.

Turning now to FIG. 2, FIG. 2 is a schematic diagram of a pumping system 104 of FIG. 1. The pumping system 104 includes a radiator assembly 200, a drive assembly 202, and a pump assembly 204 on a trailer 206. Each of these components is described below.

In one or more embodiments, the radiator assembly 200 is fluidly coupled to the drive assembly 202 and removes heat that is produced during the operation of the drive assembly 202. The trailer 206 may also include one or more secondary systems, e.g., an electric generator (not shown), a steam generation system (not shown), and a hydraulics system (not shown). The drive assembly 202 includes a prime mover (not shown) and a prime mover gearbox (not shown) positioned within a drive assembly housing 208. In various embodiments, the drive assembly 202 may utilize natural gas from the well as a fuel source.

In other embodiments, the drive assembly 202 may include a prime mover and a prime mover gearbox that are not disposed within a common housing (e.g., 208), the prime mover gearbox may be omitted, or a prime mover that utilizes a different fuel source. The prime mover may be an internal combustion engine, or an electric motor. Further, the prime mover is not limited to the aforementioned examples. The prime mover may produce power within a range of 1,000 horsepower to 20,000 horsepower; however other embodiments of the pumping system may utilize a prime mover(s) that produces less than 1,000 horsepower or more than 20,000 horsepower.

The prime mover is connected to a prime mover gearbox, either directly or through a driveshaft (not shown) extending between the prime mover and the prime mover gearbox. The prime mover gearbox is also connected to the pump assembly 204 through a driveshaft 210 that transfers rotational energy produced by the drive assembly 202 to the pump assembly 204. However, in at least one embodiment, the prime mover gearbox may be directly connected to the pump assembly 204 via a belt or chain, instead of connected through a driveshaft 210. In another embodiment, the prime mover gearbox may be omitted and the prime mover may be directly connected to the pump assembly 204 via a belt or a chain, or connected to the pump assembly 204 through a driveshaft 210.

In one or more embodiments, the prime mover gearbox is a single-speed gearbox that reduces the rotational speed and increases the torque output from the drive assembly 202. The magnitude of the reduction in rotational speed and the magnitude of the increase in torque output are based on a single-gear ratio determined by gears contained within the prime mover gearbox. In other embodiments, the prime mover gearbox is a multispeed gearbox that can be shifted between one of two or more gear ratios to adjust the rotational speed and torque output from the drive assembly 202.

Figure 3:
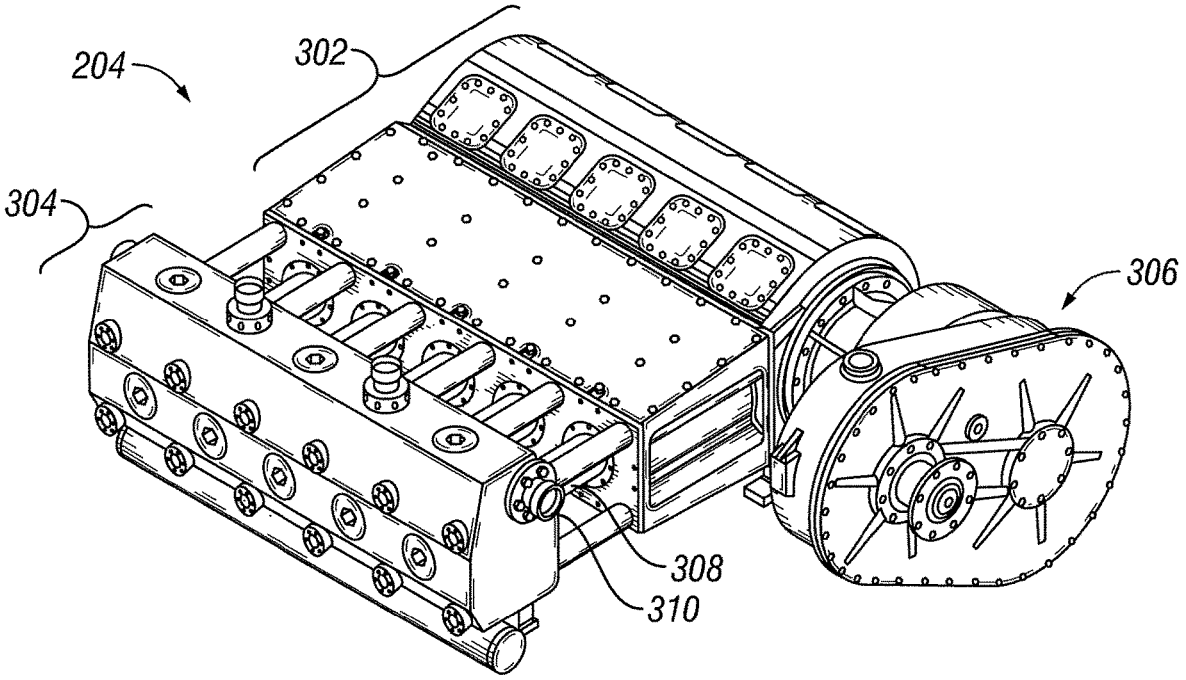
FIG. 3 is an isometric view of a power end and a fluid end of the pump assembly of FIG. 2.

FIG. 3 is an isometric view of a power end 302 and a fluid end 304 of the pump assembly 204 shown in FIG. 2. The pump assembly 204 is a reciprocating positive displacement pump that includes a crankshaft (not shown) within the power end 302 that is coupled to multiple plungers (not shown) that are disposed in the fluid end 304 of the pump assembly 204 via pony rods (not shown) disposed within cylinders 308 extending between the power end 302 and the fluid end 304. The pump assembly 204 also includes a gearbox 306 that is attached to a driveshaft (not shown) to transfer rotational energy produced by a prime mover (not shown) to the pump assembly 204.

The rotational energy from the drive assembly rotates the crankshaft within the power end 302 to reciprocate the plungers via the pony rods. The reciprocation of the plungers moves fluid from one or more storage tanks 116 through the pump assembly 204 in a manner that pressurizes the fluid. The pressurized fluid is then output from the pump assembly 204 through an outlet 310 and sent downhole to perform various operations within the wellbore or sent to various pieces of equipment (not shown) at the wellsite or within the wellbore to provide hydraulic power.

Figure 4:
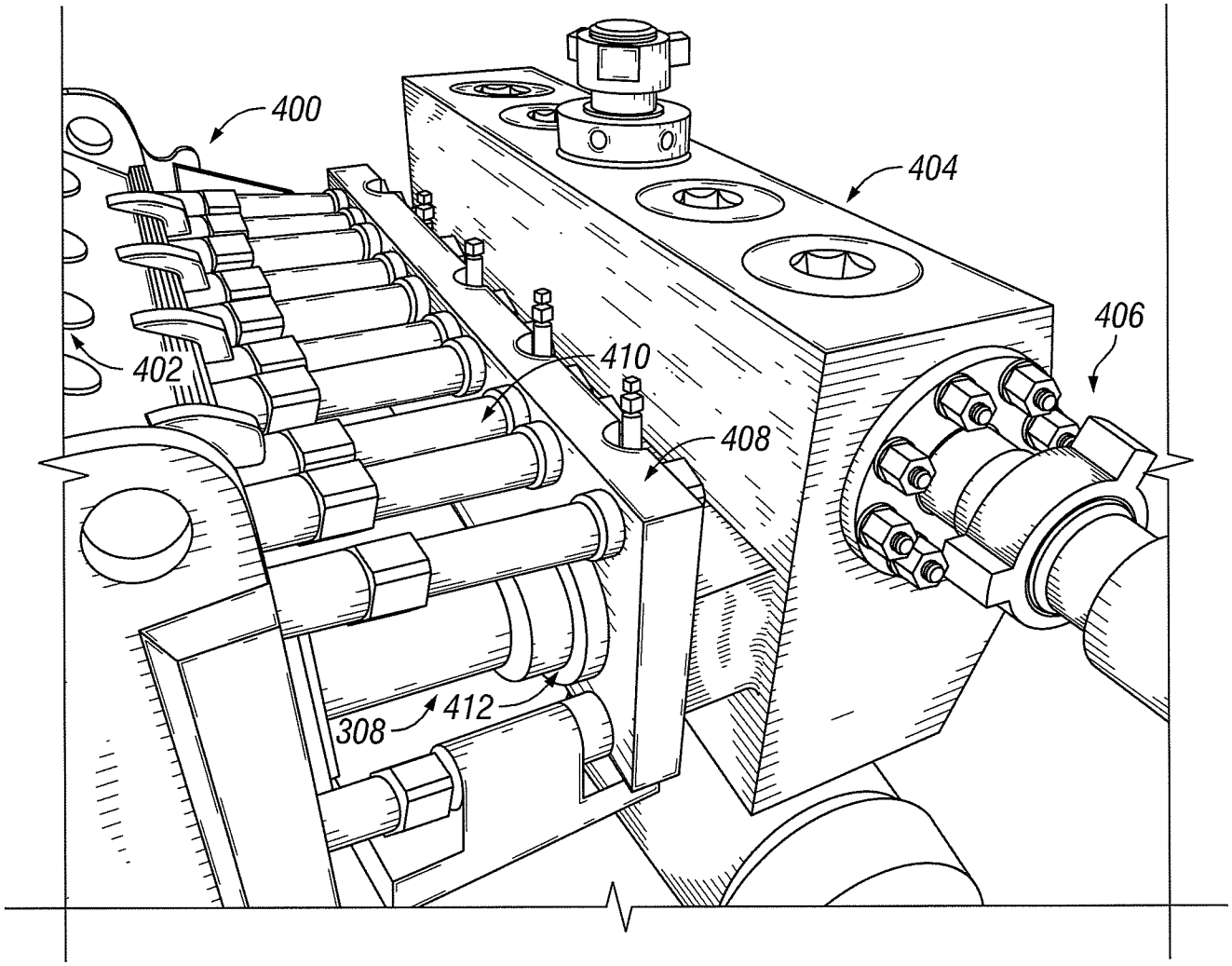
FIG. 4 is an isometric view of a fluid end of the pump assembly of FIG. 3.

Turning now to FIG. 4, FIG. 4 is an isometric view of a pump assembly 400, according to one or more embodiments. As discussed above, the fluid end 404 of the pump assembly includes plungers coupled to pony rods (not shown) disposed within cylinders 308. As the pony rod moves away from the fluid end 404, the piston inside the fluid end 404 is retracted, which creates suction that draws fluid into the piston chamber (not shown). As the pony rod moves towards the fluid end 404, the fluid within the piston chamber is pressurized and exits the fluid end 404 via an outlet 406.

The fluid end 404 also includes a mounting flange 408 for connecting the fluid end 404 to the power end 402 of the pump assembly 400 via stay rods 410 (one indicated) extending between the power end 402 and the fluid end 404. In one or more embodiments, the mounting flange 408 is integral to the body of the fluid end 404. In other embodiments, the mounting flange 408 is formed separately from the fluid end 404 and coupled to the fluid end 404. Packing nut assemblies 412 (one indicated) are threaded into the mounting flange 408 and surround the plungers. The packing nut assemblies 412 retain packing (not shown) within the fluid end 404, which prevents fluid from leaking from plunger chamber as the plungers reciprocate to pressurize fluid.

Figure 5A:
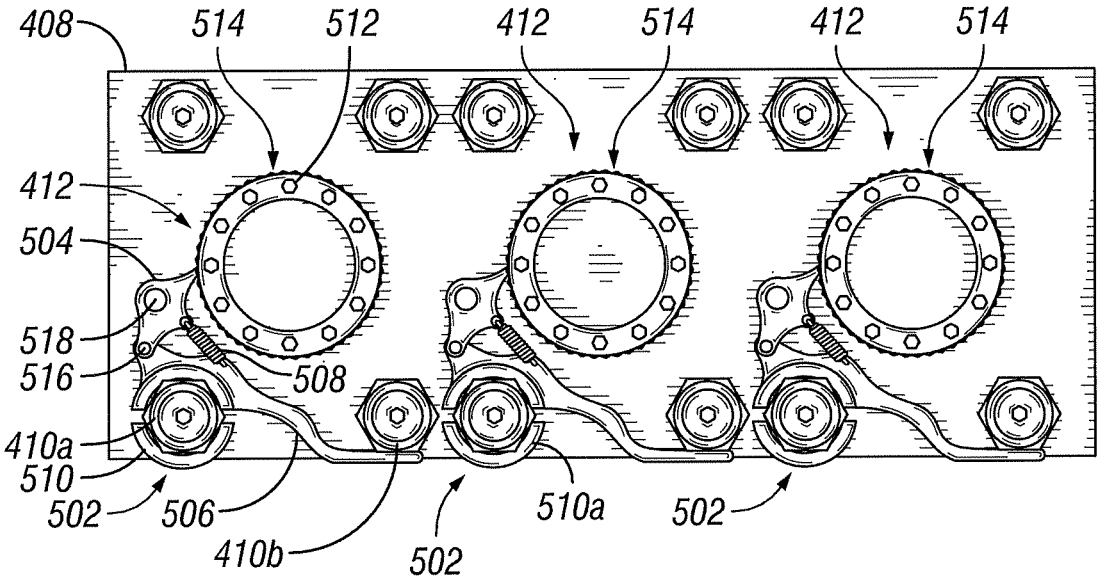
FIG. 5A is a front view of the mounting flange of the pump assembly of FIG. 4.
Figure 5B:
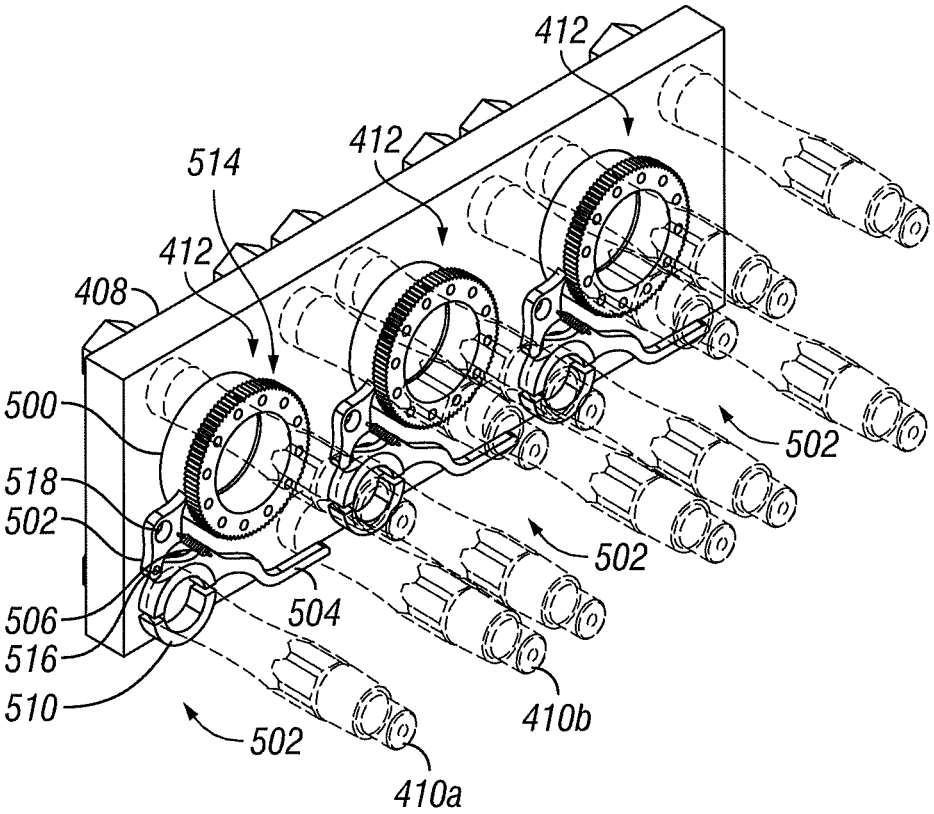
FIG. 5B is an isometric view of the mounting flange of the pump assembly of FIG. 4.
Figure 5C:
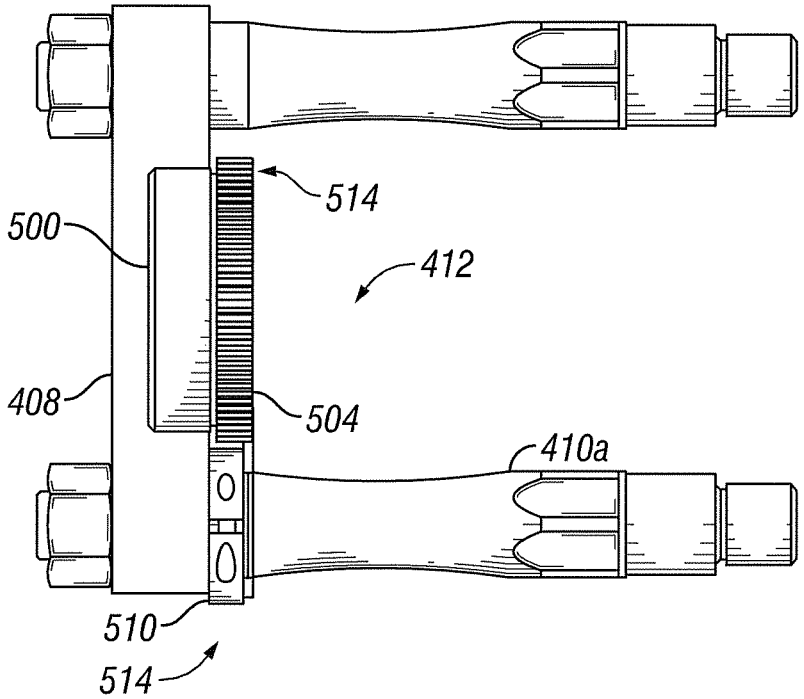
FIG. 5C is a side view of the mounting flange of the pump assembly of FIG. 4.

Turning now to FIGS. 5A-5C, FIGS. 5A-5C are front, isometric, and side views, respectively, of packing nut assemblies 412 coupled to a mounting flange 408. The packing nut assemblies 412 each include a packing nut 500 and a retention assembly 502 that includes a pawl 504, an alignment arm 506, a biasing assembly 508, such as a tension spring or pneumatic cylinder, and a collar 510.

Figure 6:
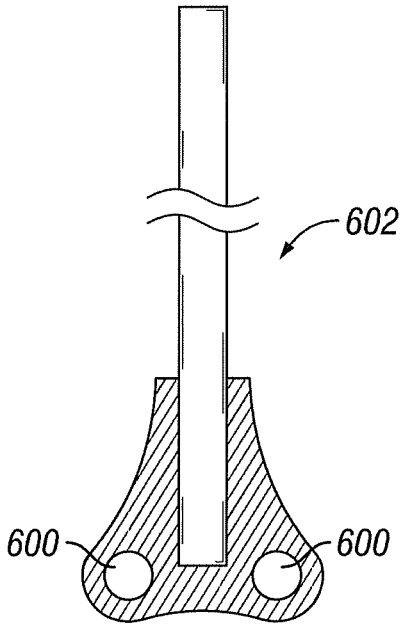
FIG. 6 is a packing nut wrench for use with the packing nut assembly shown in FIGS. 5A-5C.

As shown most clearly in FIG. 5C, the packing nut 500 is threaded into the mounting flange 408 to retain packing (not shown). To ensure that the packing nut 500 is sufficiently engaged with the mounting flange 408, the prongs 600 of a packing nut wrench 602, shown in FIG. 6, can be inserted into holes 512 formed in the exposed axial face of the packing nut 500 and the wrench 602 is used to rotate and thus install and tighten the packing nut 500.

As shown in most clearly in FIG. 5A, the collar 510 extends circumferentially around a first stay rod **410*a* and the alignment arm 506, which is coupled to or formed by the collar 510, engages with a second, adjacent stay rod 410*b*. As shown in the illustrated embodiment, the collar 510 may be a split collar made of two portions 510*a*, 510*b* that are positioned around the stay rod 410*a*. Fasteners are used to couple the two portions 510*a*, 510*b* of the split collar together and tighten the split collar around the stay rod 410*a*, coupling the collar 510 to the stay rod 410*a*. In other embodiments, the collar 510 may be continuous. The pawl 504 is coupled to the collar 510 or the alignment arm 506 via a pin 516 that allows the pawl 504** to rotate about the pin.

The alignment arm 506 is shaped such that engaging the alignment arm 506 with the second stay rod **410*b* positions the pawl 504 to engage a gear pattern 514 formed into the packing nut 500. With the alignment arm 506 engaged with the second stay rod 410*b*, the retention assembly 502 is in position and the collar 510 may be tightened. The alignment arm 506 being engaged with the second stay rod 410*b* further prevents the rotation of the collar 510 and the alignment arm 506** in a first direction.

As shown most clearly in FIGS. 5A and 5B, the biasing assembly 508 extends between the pawl 504 and the alignment arm 506 to bias the pawl 504 into engagement with the gear pattern 514 of the packing nut 500. The biasing assembly 508 causes the free end of the pawl 504 to engage the gear pattern 514, the teeth of which are angled such that the free end of the pawl can slide along a tooth as the packing nut 500 is rotated in a first direction to thread the packing 500 nut into the mounting flange 408, but cannot move along the tooth in a second direction opposite the first direction to prevent the packing nut 500 from unthreading once installed. Preventing the packing nut 500 from unthreading prevents the packing nut 500 from backing out and allowing fluid to leak out of the fluid end due to vibration of the fluid end 304 during operation of the pump assembly 204. The pawl 504 also includes a hole 518 that allows an operator to pull the pawl 504 away from the packing nut 500 to allow the packing nut 500 to move in the second direction to be removed from the mounting flange 408, which is necessary to replace the packing or service the fluid end.

Further examples include:

Example 1 is a reciprocating pump assembly. The reciprocating pump assembly includes a power end, a first stay rod and a second stay rod coupled to the power end, and a fluid end operatively coupled to the power end. The fluid end includes a mounting flange coupled to the first stay rod and the second stay rod and a packing nut assembly. The packing nut assembly includes a packing nut threadably engaged with the mounting flange and including a gear pattern, and a retention assembly. The retention assembly includes a collar, an alignment arm, a pawl, and a biasing assembly. The collar extends circumferentially around the first stay rod. The alignment arm is coupled to the collar and shaped to contact the second stay rod and prevent rotation of the collar and the alignment arm in a first direction. The pawl is pivotally coupled to at least one of the alignment arm or the collar and positioned via the alignment arm to engage the gear pattern of the packing nut to allow the packing nut to be threaded into the mounting flange and prevent the packing nut from unthreading from the mounting flange. The biasing assembly is coupled to the pawl to bias the pawl into engagement with the gear pattern of the packing nut.

In Example 2, the embodiments of any preceding paragraph or combination thereof further include wherein the biasing assembly includes a tension spring.

In Example 3, the embodiments of any preceding paragraph or combination thereof further include wherein holes are formed in an exposed axial face of the packing nut. The holes are shaped and positioned to allow installation of the packing nut via a packing nut wrench.

In Example 4, the embodiments of any preceding paragraph or combination thereof further include wherein the alignment arm is formed by a portion of the collar.

In Example 5, the embodiments of any preceding paragraph or combination thereof further include wherein the collar is a split collar that is coupled to the first stay rod.

In Example 6, the embodiments of any preceding paragraph or combination thereof further include a prime mover operatively coupled to the power end.

In Example 7, the embodiments of any preceding paragraph or combination thereof further include a gearbox.

In Example 8, the embodiments of any preceding paragraph or combination thereof further include wherein a hole is formed in the pawl and positioned to allow an operator to pull the pawl away from the packing nut to unthread the packing nut.

Example 9 is a fluid end for use with a reciprocating pump assembly including a first stay rod and a second stay rod. The fluid end includes a mounting flange to be coupled to the first stay rod and the second stay rod and a packing nut assembly. The packing nut assembly includes a packing nut threadably engaged with the mounting flange and including a gear pattern, and a retention assembly. The retention assembly includes a collar, an alignment arm, a pawl, and a biasing assembly. The collar extends circumferentially around the first stay rod. The alignment arm is coupled to the collar and shaped to contact the second stay rod and prevent rotation of the collar and the alignment arm in a first direction. The pawl is pivotally coupled to at least one of the alignment arm or the collar and positioned via the alignment arm to engage the gear pattern of the packing nut to allow the packing nut to be threaded into the mounting flange and prevent the packing nut from unthreading from the mounting flange. The biasing assembly is coupled to the pawl to bias the pawl into engagement with the gear pattern of the packing nut.

In Example 10, the embodiments of any preceding paragraph or combination thereof further include wherein the biasing assembly includes a tension spring.

In Example 11, the embodiments of any preceding paragraph or combination thereof further include wherein holes are formed in an exposed axial face of the packing nut, the holes shaped and positioned to allow installation of the packing nut via a packing nut wrench.

In Example 12, the embodiments of any preceding paragraph or combination thereof further include wherein the alignment arm is formed by a portion of the collar.

In Example 13, the embodiments of any preceding paragraph or combination thereof further include wherein the collar is a split collar that is coupled to the first stay rod.

In Example 14, the embodiments of any preceding paragraph or combination thereof further include wherein a hole is formed in the pawl and positioned to allow an operator to pull the pawl away from the packing nut to unthread the packing nut.

Example 15 is a packing nut assembly for use with a fluid end including a first stay rod and a second stay rod coupled to a mounting flange. The packing nut assembly includes a packing nut threadably engagable with the mounting flange, the packing nut including a gear pattern on a portion of the packing nut and a retention assembly. The retention assembly includes a collar, an alignment arm, a pawl, and a biasing assembly. The collar is sized to extend circumferentially around the first stay rod. The alignment arm is coupled to the collar and shaped to contact the second stay rod when the packing nut assembly is installed on the fluid end to align the collar and prevent rotation of the collar and the alignment arm in a first direction. The pawl is pivotally coupled to at least one of the alignment arm or the collar, the pawl positionable via the alignment arm to engage the gear pattern of the packing nut to allow the packing nut to be threaded into the mounting flange and prevent the packing nut from unthreading from the mounting flange. The biasing assembly is coupled to the pawl that, when the packing nut assembly is installed on the fluid end, biases the pawl into engagement with the gear pattern of the packing nut.

In Example 16, the embodiments of any preceding paragraph or combination thereof further include wherein the biasing assembly includes a tension spring.

In Example 17, the embodiments of any preceding paragraph or combination thereof further include wherein holes are formed in an exposed axial face of the packing nut, the holes are shaped and positioned to allow installation of the packing nut via a packing nut wrench.

In Example 18, the embodiments of any preceding paragraph or combination thereof further include wherein the alignment arm is formed by a portion of the collar.

In Example 19, the embodiments of any preceding paragraph or combination thereof further include wherein the collar is a split collar.

In Example 20, the embodiments of any preceding paragraph or combination thereof further include wherein a hole is formed in the pawl and positioned to allow an operator to pull the pawl away from the packing nut to unthread the packing nut.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A reciprocating pump assembly comprising:
a power end;
a first stay rod and a second stay rod coupled to the power end; and
a fluid end operatively coupled to the power end, the fluid end comprising:
a mounting flange coupled to the first stay rod and the second stay rod; and
a packing nut assembly comprising:
a packing nut threadably engaged with the mounting flange, the packing nut comprising a gear pattern; and
a retention assembly comprising:
a collar that extends circumferentially around the first stay rod;
an alignment arm coupled to the collar and shaped to contact the second stay rod to align the collar and prevent rotation of the collar and the alignment arm in a first direction;
a pawl pivotally coupled to at least one of the alignment arm or the collar, the pawl positioned via the alignment arm to engage the gear pattern of the packing nut to allow the packing nut to be threaded into the mounting flange and prevent the packing nut from unthreading from the mounting flange; and
a biasing assembly coupled to the pawl to bias the pawl into engagement with the gear pattern of the packing nut.

2. The reciprocating pump assembly of claim 1, wherein the biasing assembly comprises a tension spring.

3. The reciprocating pump assembly of claim 1, wherein holes are formed in an exposed axial face of the packing nut, the holes are shaped and positioned to allow installation of the packing nut via a packing nut wrench.

4. The reciprocating pump assembly of claim 1, wherein the alignment arm is formed by a portion of the collar.

5. The reciprocating pump assembly of claim 1, wherein the collar is a split collar that is coupled to the first stay rod.

6. The reciprocating pump assembly of claim 1, further comprising a gearbox.

7. The reciprocating pump assembly of claim 1, further comprising a prime mover operatively coupled to the power end.

8. The reciprocating pump assembly of claim 1, wherein a hole is formed in the pawl and positioned to allow an operator to pull the pawl away from the packing nut to unthread the packing nut.

9. A fluid end for use with a reciprocating pump assembly comprising a first stay rod and a second stay rod, the fluid end comprising:
a mounting flange to be coupled to the first stay rod and the second stay rod; and
a packing nut assembly comprising:
a packing nut threadably engaged with the mounting flange, the packing nut comprising a gear pattern on a portion of the packing nut; and
a retention assembly comprising:
a collar that extends circumferentially around the first stay rod;
an alignment arm coupled to the collar and shaped to contact the second stay rod to align the collar and prevent rotation of the collar and the alignment arm in a first direction;
a pawl pivotally coupled to at least one of the alignment arm or the collar, the pawl positioned via the alignment arm to engage the gear pattern of the packing nut to allow the packing nut to be threaded into the mounting flange and prevent the packing nut from unthreading from the mounting flange; and
a biasing assembly coupled to the pawl to bias the pawl into engagement with the gear pattern of the packing nut.

10. The fluid end of claim 9, wherein the biasing assembly comprises a tension spring.

11. The fluid end of claim 9, wherein holes are formed in an exposed axial face of the packing nut, the holes are shaped and positioned to allow installation of the packing nut via a packing nut wrench.

12. The fluid end of claim 9, wherein the alignment arm is formed by a portion of the collar.

13. The fluid end of claim 9, wherein the collar is a split collar that is coupled to the first stay rod.

14. The fluid end of claim 9, wherein a hole is formed in the pawl and positioned to allow an operator to pull the pawl away from the packing nut to unthread the packing nut.

15. A packing nut assembly for use with a fluid end comprising a first stay rod and a second stay rod coupled to a mounting flange, the packing nut assembly comprising:
a packing nut threadably engagable with the mounting flange, the packing nut comprising a gear pattern on a portion of the packing nut; and
a retention assembly comprising:
a collar sized to extend circumferentially around the first stay rod;
an alignment arm coupled to the collar and shaped to contact the second stay rod when the packing nut assembly is installed on the fluid end to align the collar and prevent rotation of the collar and the alignment arm in a first direction;
a pawl pivotally coupled to at least one of the alignment arm or the collar, the pawl positionable via the alignment arm to engage the gear pattern of the packing nut to allow the packing nut to be threaded into the mounting flange and prevent the packing nut from unthreading from the mounting flange; and
a biasing assembly coupled to the pawl that, when the packing nut assembly is installed on the fluid end, biases the pawl into engagement with the gear pattern of the packing nut.

16. The packing nut assembly of claim 15, wherein the biasing assembly comprises a tension spring.

17. The packing nut assembly of claim 15, wherein holes are formed in an exposed axial face of the packing nut, the holes are shaped and positioned to allow installation of the packing nut via a packing nut wrench.

18. The packing nut assembly of claim 15, wherein the alignment arm is formed by a portion of the collar.

19. The packing nut assembly of claim 15, wherein the collar is a split collar.

20. The packing nut assembly of claim 15, wherein a hole is formed in the pawl and positioned to allow an operator to pull the pawl away from the packing nut to unthread the packing nut.

* * * * *